US006080024A

United States Patent [19]

Miller et al.

[11] Patent Number: 6,080,024

[45] Date of Patent: Jun. 27, 2000

[54] MULTI-STRANDED CONDUCTOR TERMINAL ASSEMBLY HAVING RESILIENT CONTACT PAD WITH UNDULATIONS

[75] Inventors: Michael W. Miller, St. Louis; Michael J. Schinsky, Webster Groves, both of Mo.

[73] Assignee: Hubbell Incorporated, Orange, Conn.

[21] Appl. No.: 09/263,556

[22] Filed: Mar. 8, 1999

[51] Int. Cl.[7] ..... H01R 4/36

[52] U.S. Cl. ..... 439/812

[58] Field of Search ..... 439/814, 812

[56] References Cited

U.S. PATENT DOCUMENTS

| | | | |
|---|---|---|---|
| 2,499,985 | 3/1950 | Cafiero | 439/812 |
| 3,015,084 | 12/1961 | Gribble | 439/812 |
| 3,864,005 | 2/1975 | Klein | 439/812 |

*Primary Examiner*—Gary F. Paumen

*Attorney, Agent, or Firm*—Jerry M. Presson; Michael R. Swartz

[57] ABSTRACT

A multi-stranded conductor terminal assembly includes an outer housing, a termination element, a contact pad, and a fastener rotatably mounting the contact pad to an inner end of the termination element. The outer housing has a main cavity open at one end for receiving therein conductor strands of the multi-stranded conductor and an internally threaded side opening extending from an exterior side of the outer housing to the main cavity thereof. The termination element is rotatably insertable within and removable from the side opening of the outer housing. The contact pad is adapted to contact the conductor strands upon rotatable advancement of the termination element into the side opening of the outer housing toward the conductor strands in the main cavity of the outer housing. The contact pad has undulations that will maintain the contact pad in a non-rotatable contacting relation with the conductor strands as the termination element is rotated and advanced toward the conductor strands so that the contact pad thereby protects the conductor strands from frictional wear as the termination element and thus the contact pad are tightened against the conductor strands.

23 Claims, 2 Drawing Sheets

MULTI-STRANDED CONDUCTOR TERMINAL ASSEMBLY HAVING RESILIENT CONTACT PAD WITH UNDULATIONS

BACKGROUND OF THE INVENTION

1. Field of the Invention

The present invention generally relates to plugs and receptacles and, more particularly, is concerned with a multi-stranded conductor terminal assembly with a washer having undulations.

2. Description of the Prior Art

Plugs and receptacles are generally employed in and around industrial plants, both indoors and outdoors, on portable and stationary devices. Plugs and receptacles receive and house sleeves and pins which mate with one another when the plug and receptacle are connected to one another. The ends of multi-stranded conductors must be terminated in some way so as to make electrical contact with the sleeves and pins. Each of the plug and receptacle has a terminal assembly with a cavity for receiving the ends of the conductor strands of the multi-stranded conductor. The terminal assembly typically includes a set screw which is threadably rotated against the conductor wires or strands of a multi-stranded conductor such that the set screw abuts the strands and completes a wire termination.

A problem exists, however, when the set screw is rotated against the conductor strands. The end of the set screw rubs over the strands as the set screw is turned relative thereto. This rubbing causes wearing of and damage to the strands. This manner of wire termination also results in eventual loosening of the electrical connection of the set screw with the conductor strands upon expansion and contraction of the conductor strands due to thermal cycling.

Consequently, a need remains for a terminal assembly which provides a solution to the aforementioned problems in the prior art without introducing any new problems in place thereof.

SUMMARY OF THE INVENTION

The present invention provides a multi-stranded conductor terminal assembly designed to satisfy the aforementioned need. The terminal assembly of the present invention includes means for attaining a high-quality, releasably self-locking termination for screw pressure terminals such as used in industry. The terminal assembly prevents any appreciable damage to conductor strands as a threaded interface is tightened and completed. The terminal assembly employs a resilient contact pad, such as an annular wave washer, having undulations which engage the multiple conductor strands and maintain the contact pad stationary against the conductor strands as a termination element, such as a set screw, is rotated and tightened into an outer housing of the assembly toward the conductor strands. Thus, there is no abrasion or wear of the conductor strands as the termination element is tightened. Furthermore, the contact pad is made of a resiliently yieldable material such that the undulations of the contact pad continuously exert a spring pressure against the conductor strands and end of the termination element which tends to compensate for expansion and contraction of the conductor strands as they undergo thermal cycling and thereby prevents loosening of the termination between the termination element and conductor strands.

Accordingly, the present invention is directed to a multi-stranded conductor terminal assembly which comprises: (a) an outer housing having a main cavity open at one end for receiving therein electrical conductor strands of a multi-stranded conductor, the outer housing also having a side opening formed through the outer housing from an exterior side to the main cavity thereof; (b) a termination element rotatably insertable within and removable from the side opening of the outer housing, the termination element having opposite outer and inner ends; (c) a contact pad disposed adjacent to the inner end of the termination element and adapted to contact the conductor strands upon rotatable advancement of the termination element into the side opening of the outer housing toward the conductor strands in the main cavity of the outer housing; and (d) a fastener rotatably mounting the contact pad to the inner end of the termination element such that a predetermined configuration of the contact pad will maintain the contact pad in a substantially non-rotatable contacting relation with the conductor strands as the termination element is rotated and advanced toward the conductor strands so that the contact pad thereby protects the conductor strands from frictional wear as the termination element and thus the contact pad are tightened against the conductor strands of the multi-stranded conductor.

More particularly, the fastener which rotatably mounts the contact pad includes a pin having a shank portion secured within the inner end of the termination element such that the pin rotates with the termination element and a head portion connected to the shank portion and disposed externally of the termination element adjacent to the inner end thereof so as to rotatably mount the contact pad between the head portion of the pin and the inner end of the termination element. The termination element preferably is an externally threaded set screw.

Also, the contact pad is an annular washer of a predetermined configuration having a central opening smaller in diameter than the head portion of the pin and larger in diameter than an end of the shank portion of the pin where the shank portion connects to the head portion such that the end of the shank portion of the pin end extends through the central opening of the annular washer so as to mount the annular washer for undergoing rotation about the pin and relative to the termination element. The predetermined configuration of the annular washer includes at least one and preferably a plurality of undulations radiating outwardly from a center of the annular washer which are adapted to engage the conductor strands in the non-rotatable contacting relation. The annular washer is comprised of a substantially resiliently yieldable material which maintains exertion of a spring pressure action between and upon the inner end of the termination element and the conductor strands.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
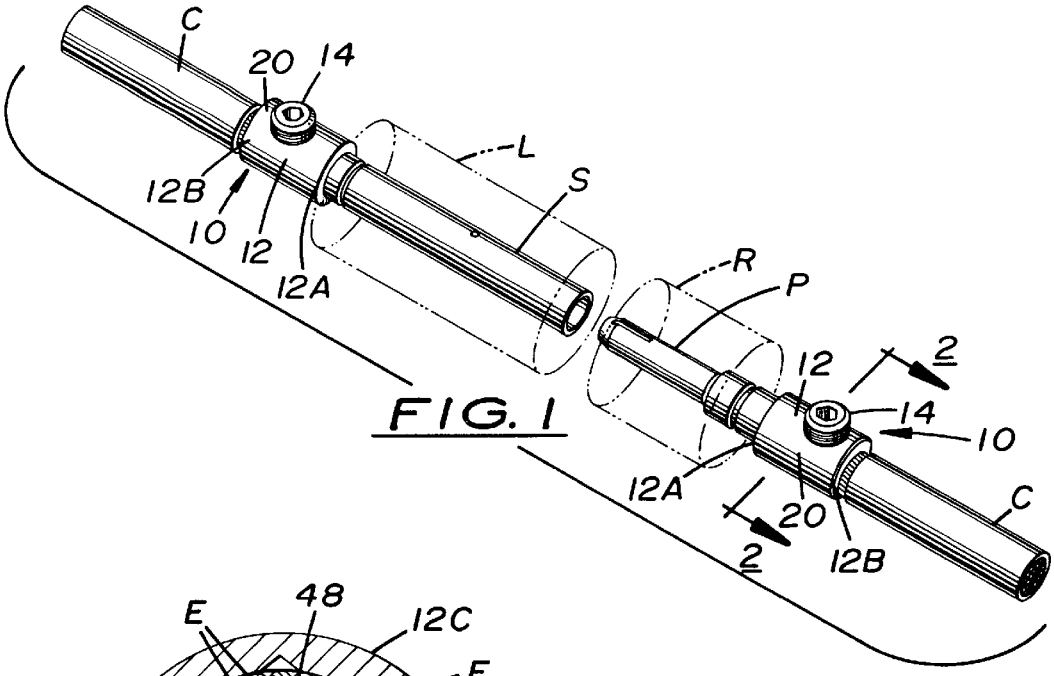
FIG. 1 is a perspective view of a plug and receptacle in dashed outline form receiving and housing a sleeve and pin which mate with one another when the plug and receptacle are connected to one another, each of the sleeve and pin employing a multi-stranded conductor terminal assembly of the present invention.
Figure 2:
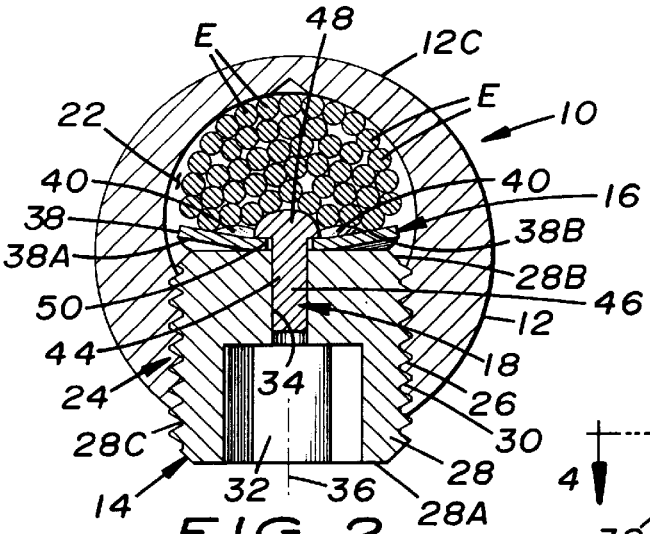
FIG. 2 is an enlarged cross-sectional view of the terminal assembly taken along line 2—2 of FIG. 1.
Figure 3:
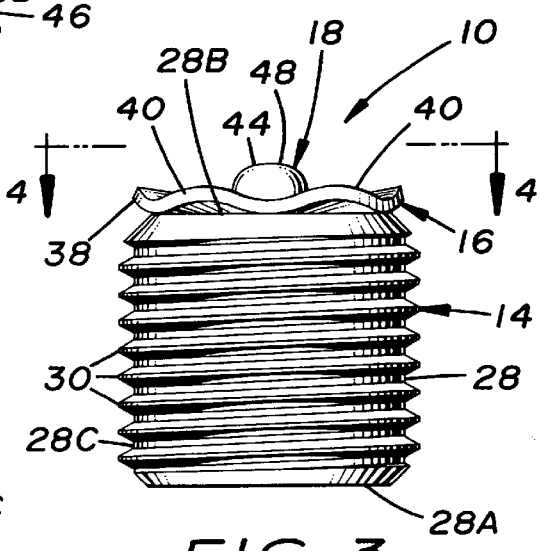
FIG. 3 is a side elevational view of the terminal assembly of FIG. 2 showing a termination element, a contact pad and a fastener of the assembly.
Figure 4:
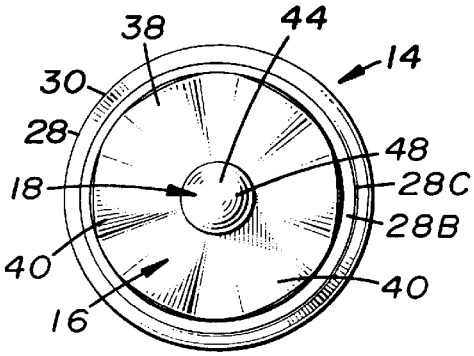
FIG. 4 is a bottom plan view of the terminal assembly as seen along line 4—4 of FIG. 3.

Referring to the drawings and particularly to FIGS. 1 to 5, there is illustrated a pair of multi-stranded conductor terminal assemblies, generally designated 10, of the present invention. The terminal assemblies 10 are respectively connected to a sleeve S of a plug L and a pin P of a receptacle R. The plug L and receptacle R are each shown in dashed outline form. The plug L receives and houses the sleeve S while the receptacle R receives and houses the pin P. The sleeve S and pin P mate with one another when the plug L and receptacle R are connected to one another. Each multi-stranded conductor terminal assembly 10 basically includes an outer housing 12, a termination element 14, an annular contact pad 16, and a fastener 18 rotatably mounting the contact pad 16 to the termination element 14.

The outer housing 12 of the terminal assembly 10 has a substantially cylindrical configuration which conforms to a similar shape of each of the sleeve S and pin P. The outer housing 12 has a pair of opposite ends 12A, 12B and a continuous side wall 20 extending between the opposite ends 12A, 12B. The side wall 20 defines an interior main cavity 22 of substantially cylindrical configuration extending through the outer housing 12 between the opposite ends 12A, 12B thereof. At one end 12A of the outer housing 12, the terminal assembly 10 is attached by any suitable means to a respective one of the sleeve S and pin P. The other end 12B of the outer housing 12 is open for receiving in the main cavity 22 the electrical conductor strands E of the multi-stranded conductor C. The side wall 20 of the outer housing 12 also defines a side opening 24 having internal threads 26 and extending from an exterior side 12C of the outer housing 12 to the main cavity 22 thereof.

Figure 5:
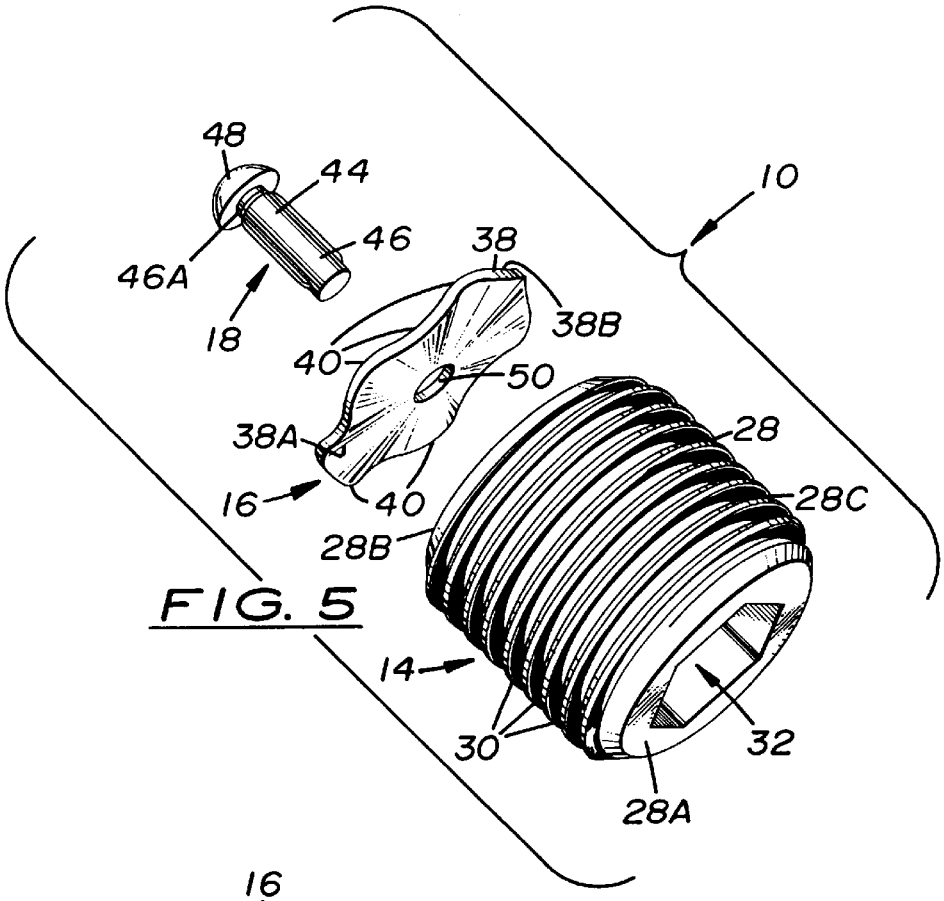
FIG. 5 is an exploded perspective view of the terminal assembly of FIG. 3.
Figure 6:
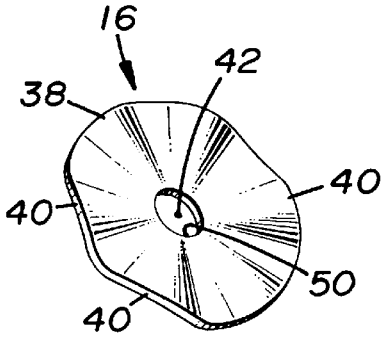
FIG. 6 is a perspective view of the contact pad of the terminal assembly.
Figure 7:
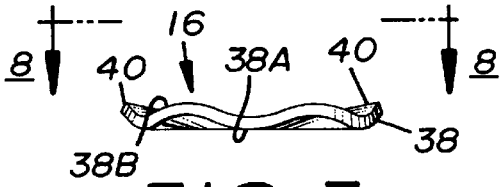
FIG. 7 is a side elevational view of the contact pad.
Figure 8:
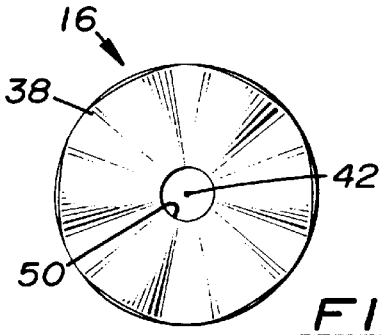
FIG. 8 is a top plan view of the contact pad as seen along line 8—8 of FIG. 7.

The termination element 14 preferably, although not necessarily, is in the form of a set screw 28. The set screw 28 is comprised of any suitable material, for example stainless steel material, and has opposite outer and inner ends 28A, 28B. The set screw 28 has a continuous side wall 28C extending between the opposite ends 28A, 28B and with exterior threads 30 formed thereon. The externally threaded set screw 28 is rotatably and threadably insertable within and removable from the internally threaded side opening 24 of the outer housing 12. The set screw 28 has means in the form of an outer recess 32 defined at the outer end 28A thereof for facilitating rotation of the set screw 28. The outer recess 32 is open at the outer end 28B of the set screw 28 for receiving and cooperating with a suitable tool (not shown) for use in rotating the set screw 28 to tighten or untightened the same. The outer recess 32 can have a substantially hexagonal configuration, as shown in FIG. 5, or may be in the form of a slot or have any other suitable configuration. The set screw 28 also has an inner passageway 34 open at the inner end 28B of the set screw 28. The inner passageway 34 extends axially into the set screw 28 to and opens into the outer recess 32. The inner passageway 34 is formed concentric to and along a central axis 36 of the set screw 28. The inner passageway 34 has a substantially cylindrical configuration and a much smaller cross-sectional size than that of the outer recess 32. Neither the outer recess 32 nor the inner passageway 34 has threads.

The contact pad 16 preferably, although not necessarily, is in the form of an annular washer 38. The annular washer 38 is rotatably mounted to the inner end 28B of the set screw 28 and adapted to contact the conductor strands E upon rotatable threading advancement of the externally threaded set screw 28 into the internally threaded side opening 24 of the outer housing 12 toward the conductor strands E in the main cavity 22 of the outer housing 12. The annular washer 38 has a pair of opposite end surfaces 38A, 38B. The inner end surface 38A faces away from the inner end 28B of the set screw 28 and toward the conductor strands E whereas the outer end surface 38B faces away from the conductor strands E and toward the inner end 28B of the set screw 28. The annular washer 38 has a predetermined configuration which includes at least one and preferably a plurality of undulations 40 that radiate outwardly from a center 42 of the annular washer 38 and are adapted to engage the conductor strands E in a non-rotatable contacting relation. As seen in FIGS. 5 to 8, the undulations 46 give the washer 38 a substantially wave-like shape. The wave-like undulations 40 of the annular washer 38 will fit with the exterior surfaces of the conductor strands E so as to maintain the annular washer 38 in the non-rotatable contacting relation therewith as the set screw 28 is threadably rotated and advanced toward the conductor strands E. In such manner, the annular washer 38 protects the conductor strands E from frictional wear or from being "machined" as the set screw 28 and thus the annular washer 38 are tightened to complete a termination with the conductor strands E.

Furthermore, the annular washer 38 is made of a substantially resiliently yieldable material which maintains exertion of a spring pressure action between and upon the inner end 28B of the set screw 28 and the conductor strands E of the multi-stranded conductor C. The spring pressure action accommodates expansion and contraction of the conductor strands E during thermal cycling thereof and so prevents loosening of the termination condition formed between the set screw 28 and conductor strands E during such thermal cycling. The spring pressure exerted when the annular washer 38 is elastically compressed due to the advancement of the set screw 28 toward the conductor strands E is the amount of pressure required to achieve good electrical contact between the annular washer 38 and the conductor strands E.

The fastener 18 of the terminal assembly 10 preferably, although not necessarily, takes the form of a pin 44 comprised of any suitable material, such as a stainless steel material. The pin 44 has a shank portion 46 fixedly interfitted within the inner passageway 34 of the set screw 28 so that the pin 44 rotates with the set screw 28. The pin 44 also has a head portion 48 integrally connected with the shank portion 46 and disposed externally of and adjacent to the inner end 28B of the set screw 28 so as to rotatably mount the annular washer 38 between the head portion 48 of the pin 44 and the inner end 28B of the set screw 28. The annular washer 38 has a central opening 50 which is larger in diameter than the end 46A of the shank portion 46 of the pin 44 where the shank portion 46 integrally connects with the head portion 48 thereof such that the end 46A of the shank portion 46 extends through the central opening 50 of the annular washer 38 so as to mount the annular washer 38 for undergoing rotation about the pin 44 and relative to the set screw 28. Although the head portion 48 of the pin 44 contacts the conductor strands E, the head portion 48 has a substantially round and smooth configuration which prevents any significant frictional wear of the conductor strands E at the point of contact between the head portion 48 and the strands E. Neither the inner passageway 34 of the set screw 28 nor the shank portion 46 of the pin 44 is threaded. Instead the pin 44 can take the form of either a drive stud type fastener which is pressed into the set screw inner passageway 34 and retained therein by an interference fit, or a rivet type fastener which is retained therein by upsetting or "mushrooming" the shank portion. In either case, the head portion 48 of the pin 44 is smoothly rounded with no sharp edges. Also there is no clamping force imposed on the annular washer 38 by the pin 44 to that the washer 38 is free to rotate or spin relative to the set screw 28.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A multi-stranded conductor terminal assembly, comprising:

(a) an outer housing having a main cavity open at one end for receiving therein a plurality of electrical conductor strands of a multi-stranded conductor, said outer housing also having a side opening formed through said outer housing from an exterior side to said main cavity thereof;

(b) a termination element rotatably insertable within and removable from said side opening of said outer housing, said termination element having opposite outer and inner ends;

(c) a contact pad disposed adjacent to said inner end of said termination element and adapted to contact the conductor strands upon rotatable advancement of said termination element into said side opening of said outer housing toward the conductor strands in said main cavity of said outer housing; and (d) a fastener rotatably mounting said contact pad to said inner end of said termination element such that a predetermined configuration of said contact pad will maintain said contact pad in a substantially non-rotatable contacting relation with the conductor strands as said termination element is rotated and advanced toward the conductor strands so that said contact pad thereby protects the conductor strands from frictional wear as said termination element and thus said contact pad are tightened against the conductor strands of the multi-stranded conductor.

2. The assembly as recited in claim 1, wherein said fastener rotatably mounting said contact pad includes a pin having a head portion and a shank portion, said shank portion of said pin being secured within said inner end of said termination element such that said pin rotates with said termination element, said head portion of said pin connected to said shank portion and being disposed externally of said termination element adjacent to said inner end thereof so as to rotatably mount said contact pad between said head portion of said pin and said inner end of said termination element.

3. The assembly as recited in claim 2, wherein said contact pad has an annular configuration and a central opening smaller in diameter than said head portion of said pin and larger in diameter than an end of said shank portion of said pin where said shank portion connects to said head portion such that said end of said shank portion of said pin end extends through said central opening of said contact pad so as to mount said contact pad for undergoing rotation about said pin and relative to said termination element.

4. The assembly as recited in claim 3, wherein said termination element has an inner passageway open at said inner end of said termination element in which said shank portion of said pin is fixedly interfitted so that said pin rotates with said termination element.

5. The assembly as recited in claim 1, wherein said termination element further has means defined at said outer end of said termination element for facilitating rotation of said termination element.

6. The assembly as recited in claim 5, wherein said means for facilitating rotation of the termination element includes an outer recess defined in said termination element and open at said outer end thereof for receiving and being cooperable with a tool for rotating said termination element.

7. The assembly as recited in claim 1, wherein said predetermined configuration of said contact pad includes at least one undulation adapted to engage the conductor strands in said non-rotatable contacting relation.

8. A multi-stranded conductor terminal assembly, comprising:

(a) an outer housing having a main cavity open at one end for receiving therin a plurality of electrical conductor strands of a multi-stranded conductor, said outer housing also having a side opening formed through said outer housing from an exterior side to said main cavity thereof;

(b) a termination element rotatably insertable within and removable from said side opening of said outer housing, said termination element having opposite outer and inner ends;

(c) a contact pad disposed adjacent to said inner end of said termination element and adapted to contact the conductor strands upon rotatable advancement of said termination element into said side opening of said outer housing toward the conductor strands in said main cavity of said outer housing; and (d) a fastener rotatably mounting said contact pad to said inner end of said termination element such that a predetermined configuration of said contact pad will maintain said contact pad in a substantially non-rotatable contacting relation with the conductor strands as said termination element is rotated and advanced toward the conductor strands so that said contact pad thereby protects the conductor strands from frictional wear as said termination element and thus said contact pad are tightened against the conductor strands of the multi-stranded conductor; wherein said predetermined configuration of said contact pad and adapted to engage the conductor strands in said non-rotatable contacting relation.

9. A Multi-stranded conductor terminal assembly, comprising:

(a) an outer housing having a main cavity open at one end for receiving therin a plurality of electrical conductor strands of a multi-stranded conductor, said outer housing also having a side opening formed through said outer housing from an exterior side to said main cavity thereof;

(b) a termination element rotatably insertable within and removable from said side opening of said outer housing, said termination element having opposite outer and inner ends;

(c) a contact pad disposed adjacent to said inner end of said termination element and adapted to contact the conductor strands upon rotatable advancement of said termination element into said side opening of said outer housing toward the conductor strands in said main cavity of said outer housing; and (d) a fastener rotatably mounting said contact pad to said inner end of said termination element such that a predetermined configuration of said contact pad will maintain said contact pad in a substantially non-rotatable contacting relation with the conductor strands as said termination element is rotated and advanced toward the conductor strands so that said contact pad thereby protects the conductor strands from frictional wear as said termination element and thus said contact pad are tightened against the conductor strands of the multi-stranded conductor; wherein said contact pad has a pair of opposite end surfaces, an inner one of said end surfaces facing away from said inner end of said termination element and toward the conductor strands of the multi-stranded conductor, an outer one of said end surfaces facing away from the conductor strands and toward said inner end of said termination element, said predetermined configuration of said contact pad includes at least one undulation defined by said opposite end surfaces of said contact pad being adapted to engage the conductor strands in said non-rotatable contacting relation.

10. The assembly as recited in claim 9, wherein said predetermined configuration of said contact pad includes a plurality of undulations defined by said opposite end surfaces of said contact pad being adapted to engage the conductor strands in said non-rotatable contacting relation.

11. The assembly as recited in claim 10, wherein said contact pad is comprised of a substantially resiliently yieldable material which maintains exertion of a spring pressure action between and upon said inner end of said termination element and the conductor strands of the multi-stranded conductor.

12. A multi-stranded conductor terminal assembly, comprising:

(a) an outer housing having a main cavity open at least at one end of said outer housing for receiving therein a plurality of electrical conductor strands of a multi-stranded conductor, said outer housing also having an internally threaded side opening formed through said outer housing from an exterior side to said main cavity thereof;

(b) an externally threaded set screw threadably insertable within and removable from said internally threaded side opening of said outer housing, said set screw having opposite outer and inner ends;

(c) an annular washer disposed adjacent to said inner end of said set screw and adapted to contact the conductor strands upon rotatably threading advancement of said set screw into said side opening of said outer housing toward the conductor strands in said main cavity of said outer housing; and (d) a pin rotatably mounting said annular washer to said inner end of said set screw such that a predetermined configuration of said annular washer will maintain said annular washer in a substantially non-rotatable contacting relation with the conductor strands as said set screw is rotated and threadably advanced toward the conductor strands so that said annular washer thereby protects the conductor strands from frictional wear as said set screw and thus said annular washer are tightened against the conductor strands of the multi-stranded conductor, said pin having a shank portion secured within said inner end of said set screw such that said pin rotates with said set screw and a head portion connected to said shank portion and disposed externally of said set screw adjacent to said inner end thereof so as to rotatably mount said annular washer between said head portion and said inner end of said set screw.

13. The assembly as recited in claim 12, wherein said annular washer has a central opening smaller in diameter than said head portion of said pin and larger in diameter than an end of said shank portion of said pin where said shank portion connects to said head portion such that said end of said shank portion of said pin extends through said central opening of said annular washer so as to mount said annular washer for undergoing rotation about said pin and relative to said set screw.

14. The assembly as recited in claim 13, wherein said set screw has an inner passageway open at said inner end of said set screw in which said shank portion of said pin is fixedly interfitted so that said pin rotates with said set screw.

15. The assembly as recited in claim 12, wherein said set screw further has means defined at said outer end of said set screw for facilitating rotation of said set screw.

16. The assembly as recited in claim 15, wherein said means for facilitating rotation of the set screw includes an outer recess defined in said set screw and open at said outer end thereof for receiving and being cooperable with a tool for rotating said set screw.

17. The assembly as recited in claim 12, wherein said predetermined configuration of said annular washer includes at least one undulation adapted to engage the conductor strands in said non-rotatable contacting relation.

18. The assembly as recited in claim 12, wherein said predetermined configuration of said annular washer includes a plurality of undulations radiating outwardly from a center of said contact pad and adapted to engage the conductor strands in said non-rotatable contacting relation.

19. The assembly as recited in claim 12, wherein said annular washer is comprised of a substantially resiliently yieldable material which maintains exertion of a spring pressure action between and upon said inner end of said set screw and the conductor strands of the multi-stranded conductor.

20. The assembly as recited in claim 12, wherein said annular washer has a pair of opposite end surfaces, an inner one of said end surfaces facing away from said inner end of said set screw and toward the conductor strands of the multi-stranded conductor, an outer one of said end surfaces facing away from the conductor strands and toward said inner end of said set screw.

21. The assembly as recited in claim 20, wherein said predetermined configuration of said annular washer includes at least one undulation defined by said opposite end surfaces of said annular washer being adapted to engage the conductor strands in said non-rotatable contacting relation.

22. The assembly as recited in claim 20, wherein said predetermined configuration of said annular washer includes a plurality of undulations defined by said opposite end surfaces of said annular washer being adapted to engage the conductor strands in said non-rotatable contacting relation.

23. The assembly as recited in claim 22, wherein said annular washer is comprised of a substantially resiliently yieldable material which maintains exertion of a spring pressure action between and upon said inner end of said set screw and the conductor strands of the multi-stranded conductor.

* * * * *